US006330740B1

(12) United States Patent
Krempels

(10) Patent No.: US 6,330,740 B1
(45) Date of Patent: Dec. 18, 2001

(54) PROCESS FOR MAKING AND FINISHING A STAMPED PART HAVING COLORED, TEXTURED SURFACE

(75) Inventor: Alan C. Krempels, Mundelein, IL (US)

(73) Assignee: GAM Investments, L.L.C., Schiller Park, IL (US)

( * ) Notice: Subject to any disclaimer, the term of this patent is extended or adjusted under 35 U.S.C. 154(b) by 0 days.

(21) Appl. No.: 09/466,263

(22) Filed: Dec. 17, 1999

(51) Int. Cl.[7] ..... B23P 17/00

(52) U.S. Cl. ..... 29/527.4; 427/261; 427/406; 428/632; 428/687

(58) Field of Search ..... 29/527.4; 427/406, 427/261; 428/609, 612, 632, 659, 687

(56) References Cited

U.S. PATENT DOCUMENTS 5,495,654 * 3/1996 Goodhart et al. ..... 29/527.4

5,591,534 * 1/1997 Vigeant et al. ..... 428/612

* cited by examiner

*Primary Examiner*—P. W. Echols
(74) *Attorney, Agent, or Firm*—Rockey, Milnamow & Katz, Ltd.

(57) ABSTRACT

A part is stamped from a steel sheet having a textured surface. The stamped part is coated with a zinc layer. The zinc layer is coated with a chromate conversion layer, either yellow-colored or black-colored. Preferably, the textured surface is produced by embossing the steel sheet. Alternatively, the textured surface is produced by etching, shot peening, or sand blasting the sheet steel. An exterior surface comprised of at least some of the textured surface of the part, as coated with such layers, has a finish simulating the similarly-colored, textured finish that the part would have if the part were stamped from a steel sheet so that the part would have a smooth, exterior surface and if the smooth, exterior surface were to be electrostatically coated with a black-colored, epoxy powder, which would be heat-cured.

7 Claims, 1 Drawing Sheet

PROCESS FOR MAKING AND FINISHING A STAMPED PART HAVING COLORED, TEXTURED SURFACE

TECHNICAL FIELD OF THE INVENTION

This invention pertains to a stamped, finished part, as exemplified by but not limited to an edge connector for a circuit board. According to this invention, the part has a textured surface having a finish simulating the colored, textured finish that the part would have if the part were to be stamped from a steel sheet so that the part would have a smooth, exterior surface and if the smooth, exterior surface were to be electrostatically coated with a black-colored, epoxy powder, which would be heat-cured. This invention pertains also to a process for making and finishing such a part.

BACKGROUND OF THE INVENTION

Heretofore, it has been common to make a part, such as an edge connector for a circuit board, by stamping the part from a steel sheet so that the part has a smooth, exterior surface, causing the smooth, exterior surface to be electrostatically coated with a suitably colored, epoxy powder, and causing the epoxy powder coating the smooth, exterior surface to be heat-cured. Commonly, a black-colored, epoxy powder is employed. When the suitably colored, epoxy powder is cured, the exterior surface develops a similarly colored, textured finish, which is comprised of a multiplicity of minute elevations and a multiplicity of minute depressions.

SUMMARY OF THE INVENTION

This invention provides a stamped, finished part, as exemplified by but not limited to an edge connector for a circuit board. The part is stamped from a steel sheet having a textured, exterior surface. The part is coated with a zinc layer, which is coated with a colored, chromate conversion layer. Although the chromate conversion layer can be yellow-colored or black-colored, a black-colored, chromate conversion layer is preferred.

The textured, exterior surface, as coated with those layers, has a finish simulating the colored, textured finish that the exterior surface would have if the part were to be stamped from a steel sheet so that the part would have a smooth, exterior surface and if the smooth, exterior surface were to be electrostatically coated with a black-colored, epoxy powder, which would be heat-cured.

This invention also provides a process for making and finishing such a part. The process comprises steps of providing a steel sheet having a textured surface, stamping the part from the steel sheet so that the part has an exterior surface comprised of at least some of the textured surface, coating the stamped part with a zinc layer, and coating the zinc layer with a colored, chromate conversion layer. Although the chromate conversion layer can be yellow-colored or black-colored, a black-colored, chromate conversion layer is preferred.

Those steps are performed so that the exterior surface of the part, as coated in the coating steps, has a finish simulating the colored, textured finish that the exterior surface would have if the part were to be stamped from a steel sheet so that the part would have a smooth, exterior surface and if the smooth, exterior surface were to be electrostatically coated with a similarly colored, epoxy powder, which would be heat-cured.

Preferably, the textured surface is produced by embossing the steel sheet. Alternatively, the surface texture is produced by etching, shot peening, or sand blasting the steel sheet.

As compared to the prior art of making and finishing a part by stamping the part from a steel sheet so as to have a smooth, exterior surface, by causing the smooth, exterior surface to be electrostatically coated with a suitably colored, epoxy powder, and causing the epoxy powder coating the smooth, exterior surface to be heat-cured, the process of this invention, as described above, provides cost savings.

These and other objects, features, and advantages of this invention are explained in the following description of a preferred mode for carrying out this invention, with reference to the accompanying drawings.

DETAILED DESCRIPTION OF THE PREFERRED MODE

Figure 1:
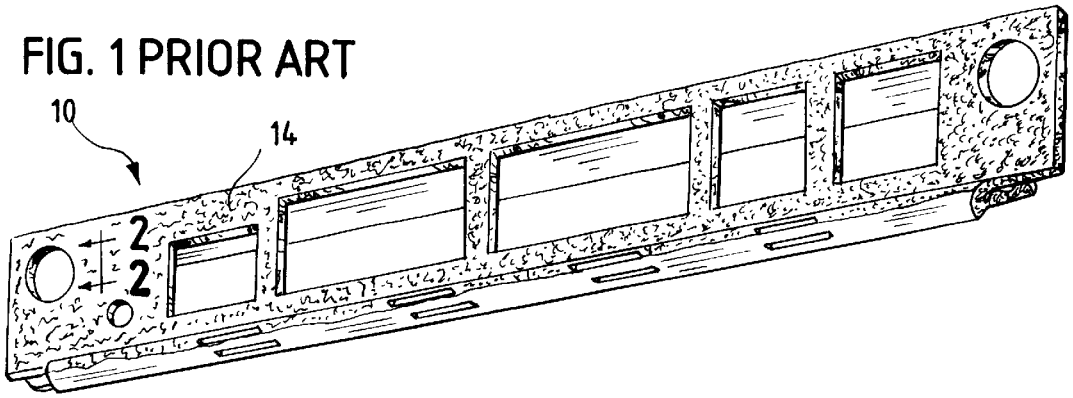
FIG. 1 PRIOR ART
FIG. 1 is a perspective view of an edge connector according to prior art.
Figure 2:
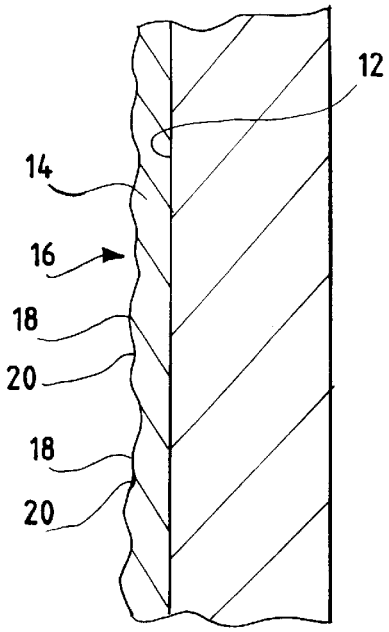
FIG. 2 PRIOR ART
FIG. 2 is a greatly enlarged, sectional detail taken along line 2—2 of FIG. 1, in a direction indicated by arrows.

As illustrated in FIGS. 1 and 2, an edge connector 10 according to prior art is made by stamping the edge connector 10 from a steel sheet so that the edge connector 10 has a smooth, exterior surface 12, by causing the smooth, exterior surface 12 to be electrostatically coated with a suitably colored, epoxy powder 14, and causing the epoxy powder 14 coating the smooth, exterior surface 12 to be heat-cured. Commonly, a black-colored, epoxy powder 14 is employed. When the suitably colored, epoxy powder 14 is cured, the exterior surface 12 develops a similarly colored, textured finish 16, which is comprised of a multiplicity of minute elevations 18 and a multiplicity of minute depressions 20.

Figure 3:
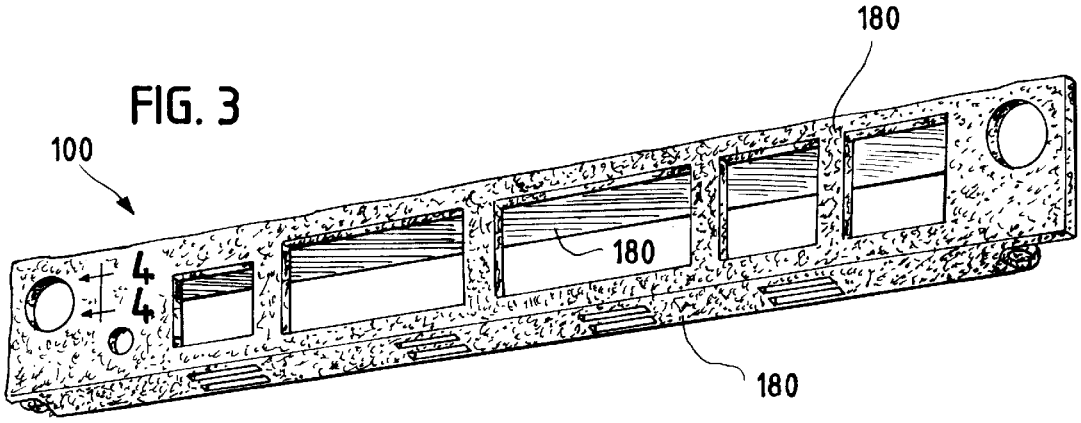
FIG. 3 is a perspective view of an edge connector according to prior art.
Figure 4:
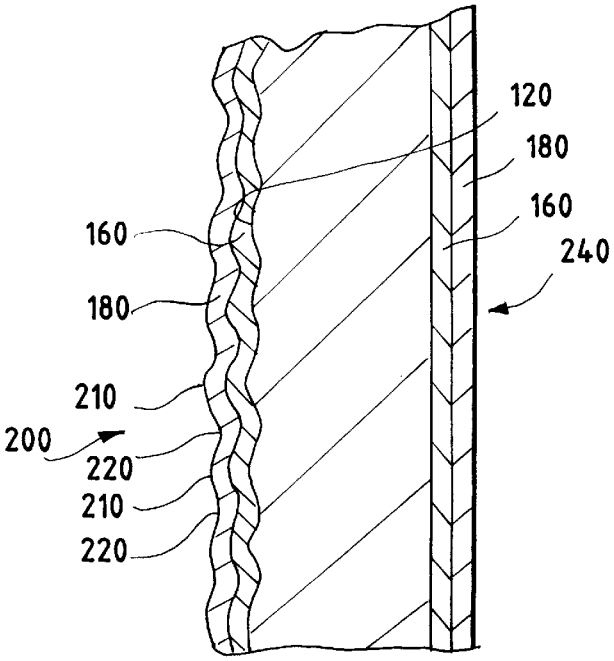
FIG. 4 is a greatly enlarged, sectional detail taken along line 4—4 of FIG. 3, in a direction indicated by arrows.

As shown in FIGS. 3 and 4, an edge connector 100 according to this invention is made and finished by providing a steel sheet having a textured surface, stamping the edge connector 100 from the steel sheet so that the edge connector 100 has an exterior surface 120 comprised of at least some of the textured surface, and so that the edge connector 100 has an interior surface 140 that remains smooth, coating the edge connector 100, as stamped, with a zinc layer 160, and coating the zinc layer 160 with a colored, chromate conversion layer 180. Although the chromate conversion layer 180 can be yellow-colored or black-colored, a black-colored, chromate conversion layer 180 is preferred.

Because of the textured surface of the steel sheet, the exterior surface 120, as coated with the respective layers 160, 180, has a finish 200 comprised of a multiplicity of minute elevations 210 and a multiplicity of minute depressions 220. The finish 200 simulates the colored, textured finish that the exterior surface would have if the edge connector were to be stamped from a steel sheet so as to have a smooth, exterior surface and if the smooth, exterior surface were to be electrostatically coated with a similarly colored, epoxy powder, which would be heat-cured. The interior surface 140, as coated similarly, has a smooth finish 240.

Preferably, the textured surface is produced by embossing the steel sheet. Alternatively, the surface texture is produced by etching, shot peening, or sand blasting the steel sheet.

This invention is not limited to an edge connector, as described above, but is applicable to a wide variety of other parts that are stampable from steel sheets.

What is claimed is:

1. A process for making and finishing a part, the process comprising steps of (a) providing a steel sheet having a textured surface, (b) stamping the part from the steel sheet so that the part has an exterior surface comprised of at least some of the textured surface, (c) coating the stamped part with a zinc layer, and (d) coating the zinc layer with a colored, chromate conversion layer, wherein said steps are performed so that the exterior surface of the part, as coated in the coating steps, has a finish simulating the colored, textured finish that the exterior surface would have if the part were to be stamped from a steel sheet so that the part would have a smooth, exterior surface and if the smooth, exterior surface were to be electrostatically coated with a similarly colored, epoxy powder, which would be heat-cured.

2. A process for making and finishing a part, the process comprising steps of (a) providing a steel sheet having a textured surface, (b) stamping the part from the steel sheet so that the part has an exterior surface comprised of at least some of the textured surface, (c) coating the stamped part with a zinc layer, and (d) coating the zinc layer with a yellow-colored, chromate conversion layer, wherein said steps are performed so that the exterior surface of the part, as coated in the coating steps, has a finish simulating the yellow-colored, textured finish that exterior surface would have if the part were to be stamped from a steel sheet so that the part would have a smooth, exterior surface and if the smooth, exterior surface were to be electrostatically coated with a yellow-colored, epoxy powder, which would be heat-cured.

3. A process for making and finishing a part, the process comprising steps of (a) providing a steel sheet having a textured surface, (b) stamping the part from the steel sheet so that the part has an exterior surface comprised of at least some of the textured surface, (c) coating the stamped part with a zinc layer, and (d) coating the zinc layer with a black-colored, chromate conversion layer, wherein said steps are performed so that the exterior surface of the part, as coated in the coating steps, has a finish simulating the black-colored, textured finish that the exterior surface would have if the part were to be stamped from a steel sheet so that the part would have a smooth, exterior surface and if the smooth, exterior surface were to be electrostatically coated with a black-colored, epoxy powder, which would be heat-cured.

4. The process of claim 1, 2 or 3 wherein the textured surface is produced by embossing the steel sheet.

5. The process of claim 1, 2, or 3 wherein the textured surface is produced by etching the steel sheet.

6. The process of claim 1, 2, or 3 wherein the textured surface is produced by shot peening the steel sheet.

7. The process of claim 1, 2, or 3 wherein the textured surface is produced by sand blasting the steel sheet.

* * * * *